United States Patent [19]

Kao

[11] 4,215,437

[45] Aug. 5, 1980

[54] HELMET-MASK FOR COLD WEATHER AND/OR PARTICULATE LADEN ENVIRONMENTS

[76] Inventor: Ti Kao, 61-14 Austin St., Rego Park, N.Y. 11374

[21] Appl. No.: 43,957

[22] Filed: May 30, 1979

[51] Int. Cl.[2] ..... A42B 3/00; A62B 18/02

[52] U.S. Cl. ..... 2/424; 2/438; 2/5; 2/10; 128/201.24

[58] Field of Search ..... 2/424, 438, 410, 5, 2/6, 8, 9, 205, 10; 128/142.6, 142.7, 146.5, 146.6

[56] References Cited

U.S. PATENT DOCUMENTS

| | | | |
|---|---|---|---|
| 1,691,648 | 11/1928 | Drager | 128/142.6 |
| 2,377,122 | 5/1945 | Bakke | 128/142.6 X |
| 2,642,574 | 6/1953 | Eloranta | 2/205 |
| 4,021,878 | 5/1977 | Peillex | 2/438 X |

FOREIGN PATENT DOCUMENTS

| | | | |
|---|---|---|---|
| 2645262 | 4/1978 | Fed. Rep. of Germany | 2/438 |

*Primary Examiner*—Peter P. Nerbun
*Attorney, Agent, or Firm*—Jordan and Hamburg

[57] ABSTRACT

A face mask comprising a head covering, a sealing means for isolating the head covering from the atmosphere when the head covering is worn, an air outlet and inlet section connected to the head covering and wiper means provided at the head covering. The air outlet and inlet section comprises a hollow joint member having upper and lower ends and an opening at a side section thereof, outer conduit means, one end being rotatably secured to a front lower portion of the head covering, and the other end being secured to the upper end of the joint member, inner conduit means connected at one end to the opening of the joint member and extending within the outer conduit up to the front lower portion of the head covering, a flexible conduit means secured at one end to the lower end of the joint member and having a free end to which filter means is connected, first valve means operatively situated in the joint member so that when the air is inhaled into the head covering, only the first valve means opens, and second valve means operatively situated at a free end of the inner conduit means so that when air is exhaled to the atmosphere, only the second valve means opens.

3 Claims, 4 Drawing Figures

HELMET-MASK FOR COLD WEATHER AND/OR PARTICULATE LADEN ENVIRONMENTS

BACKGROUND OF THE INVENTION AND PRIOR ART STATEMENT

The invention relates to a face mask, more particularly, a helmet type face mask adapted to be used in cold environments for protecting the wearer's face from the cold, as well as providing warm air to the wearer, or in dusty or other environments contaminated with airborne particulate matter for protecting the face and eyes and providing clean air to the wearer.

In the past, there have been disclosed many face masks for various purposes. However, such face masks, even if designed for cold environments, are not fully satisfactory.

In U.S. Pat. No. 1,262,566, there is disclosed a tunnel mask, which comprises outer and inner walls covering the head of the wearer, openings within the walls covered with glass, an inlet port at the outer wall from which an air supply pipe extends outwardly, and outlet ports provided at the inner wall. When air is inhaled, air enters the interior of the mask through the air supply pipe, the inlet port and the outlet ports. Then, the air is exhaled to the atmosphere out of the bottom of the mask. Since the mask does not sealingly cover the head of the wearer, the mask is not suitable for cold environments and environments contaminated with airborne particulate matter.

A portable respiratory apparatus is disclosed in U.S. Pat. No. 3,902,486. The apparatus comprises a body including inlet and outlet valves, a mask secured to the body and a conduit connected to the inlet valve of the body. When air is inhaled, air enters the mask through the conduit and the inlet valve, whereas the outlet valve closes. While, in case of exhalation of the air, the inlet valve closes and the air flows out through the outlet valve. A lower end of the conduit can be carried in clothing of the user. However, in a cold environment, inspired air is directly exhaled to the atmosphere through the outlet valve; therefore, the outlet valve may not properly operate due to freezing on the outlet valve of moisture contained in the exhaled air.

Therefore, an object of the invention is to provide a face mask adapted for use in cold environments as well as in environments contaminated with airborne particulate matter.

Another object of the invention is to provide a face mask, in which the field of view of the face mask is kept clear.

A further object of the invention is to provide a face mask which is light and easily worn by the user.

Still further objects and advantages of the invention will be apparent from the following description.

SUMMARY OF THE INVENTION

The apparatus of the invention comprises a head covering to substantially cover the head of the wearer, the head covering having a window formed of transparent sheet, sealing means secured to the head covering for isolating the inside of the head covering from the atmosphere when the head covering is worn, a hollow joint member having upper and lower ends and an opening at a side section thereof, outer conduit means, one end being rotatably secured to a front lower portion of the head covering and the other end being secured to the upper end of the joint member, inner conduit means connected at one end to the opening of the joint member and extending within the outer conduit up to the front lower portion of the head covering, a flexible conduit means secured at one end to the lower end of the joint member and having a free end to which filter means is connected, first valve means operatively situated in the joint member so that when air is inhaled into the head covering only the first valve means opens, second valve means operatively situated in a free end of the inner conduit means so that when air is exhaled to the atmosphere, only the second valve means opens, and wiper means secured at a front upper portion of the head covering.

In cold environments, the free end of the flexible conduit means may be disposed within the clothing of the user to collect air warmed by the user's body heat. This warm air is inhaled by the wearer through the first valve means. The second valve means is situated at the inner conduit means and is substantially covered by the outer conduit means supplied with warm air. Thus, even if the atmosphere is very cold, the second valve means does not freeze due to moisture collecting thereon. If the second valve means is directly exposed to the cold atmosphere, the valve will freeze and, therefore, the mask will become inoperative.

The wiper means comprises motor means, battery means and outer and inner blades operatively connected to the motor means. The outer and inner blades face one another and bear against the respective faces of the window of the head covering, so that both faces of the window are kept clear.

The sealing means, preferably, includes first fastening means at an upper area thereof to be detachably connected to a neck portion of the head covering and second fastening means at a lower area thereof to be fixed to the neck of the wearer. The sealing means may be usually secured to the neck portion of the head covering, but the sealing means is detachable therefrom to clean or wash the same.

DETAILED DESCRIPTION OF A PREFERRED EMBODIMENT

Figure 1:
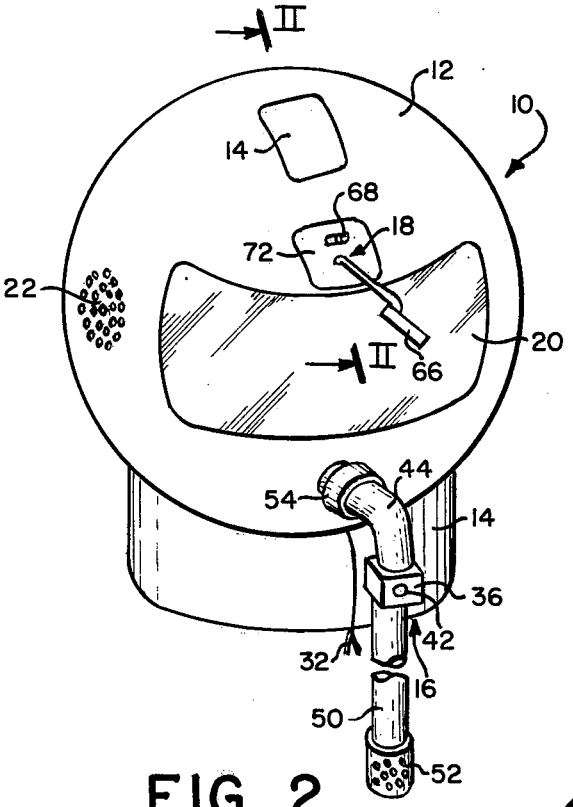
FIG. 1 is a perspective view of the face mask according to the invention.
Figure 3:
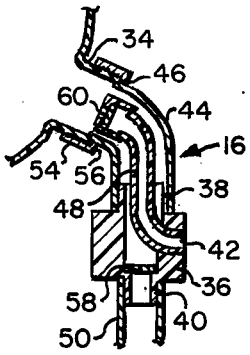
FIG. 3 is a cross-sectional view of air outlet and inlet sections of the invention.
Figure 2:
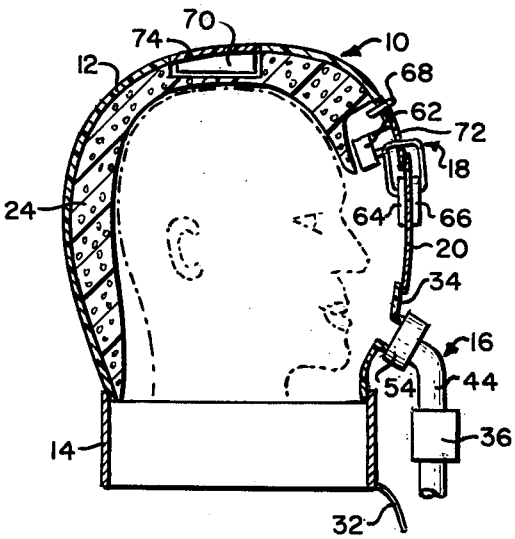
FIG. 2 is a partial cross-section view taken on line II—II in FIG. 1.

Referring to FIGS. 1 and 2, there is disclosed a face mask 10 according to the present invention. The face mask 10 comprises a head covering 12, a sealing strip 14 for sealing the head covering 12 from the atmosphere when the head covering is worn, an air outlet and inlet section 16 connected to the head covering, and wiper means 18 provided on the head covering. The head covering 12 is made of plastic and includes a transparent plastic window 20 and a plurality of small holes 22 at both lateral sides thereof. The holes 22 serve to convey outer sound to the wearer. Inside the head covering 12, a lining 24 made of plastic foam is attached, so that the head of the wearer properly fits into the head covering 12.

Figure 4:
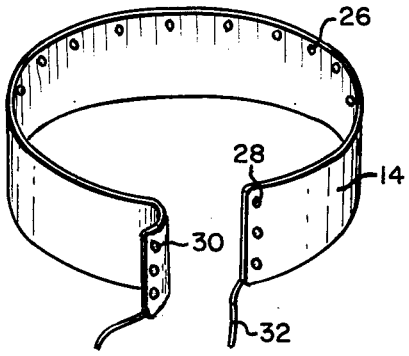
FIG. 4 is a perspective view of the sealing means of the invention.

The sealing strip 14 (see FIG. 4) made of flexible material, such as cloth or leather, comprises first fasteners 26 at an upper inside section thereof, second and third fasteners 28 and 30 and a string 32 extending through a lower edge thereof. The first fasteners 26 engage with complimentary fasteners (not shown) provided at the lower section of the head covering 12 and the second and third fasteners 28 and 30 are snapped together. Therefore, all the fasteners are properly engaged and the string 32 is tightened and tied, so that the inside of the head covering 12 is substantially isolated from the atmosphere.

The air outlet and inlet section 16 is rotatably secured to a projection 34 of the head covering 12 which is situated below the window. The section 16 comprises a hollow joint 36 including upper and lower ends 38 and 40 and a side opening 42, an outer conduit 44 connected at one end to the upper end 38 and having a shoulder 46 at the other end thereof, and an inner conduit 48 connected to the opening 42. The conduit 48 extends within the outer conduit 44 and ends near the shoulder 46. A flexible conduit 50 having a filter frame 52 at a lower end thereof is connected to the lower end 40 of the joint 36. Open cell plastic foam or any other suitable conventional filter material is provided within the filter frame. The conduit 50 may be rubber or a bendable metal hose, but preferably it is of such a type that if bent, it remains as it is.

Outside the outer conduit 44, there is provided a nut 54 having a shoulder 56 which abuts the shoulder 46 of the outer conduit 44. The nut 54 is threadably connected to the projection 34, so that if the nut 54 is loosened, the outer conduit 44 can be turned freely.

An inlet valve 58 is situated on a shoulder of the joint 36, while an outlet valve 60 is positioned at an end of the inner conduit 48 near the head covering 12. The valves are operated so that when air is inhaled, only the inlet valve 58 opens, air thereby flowing into the head covering 12 through the conduit 50 and 44, while when air is exhaled, the inlet valve 58 closes and the outlet valve 60 opens, air thereby flowing to the atmosphere through the inner conduit 48 and the opening 42.

In case the face mask 10 is used in a cold environment, the conduit 50 is disposed within the clothing of the wearer, so that warm air can be obtained. The warm air flows into the outer conduit as well as the inside of the head covering 12. Therefore, the outlet valve 60 is not directly exposed to the cold atmosphere and, consequently, if moisture in the air condenses on the outlet valve 60, the moisture does not freeze and the outlet valve 60 works properly.

The wiper means 18 comprises a motor 62, inner and outer blades 64 and 66 secured to a shaft of the motor 62, a switch 68, and a battery 70. The motor 62, the switch 68 and the battery 70 are connected with each other but the conventional circuit means involved is not shown in FIG. 2. The motor 62 and the switch 68 are provided on a plate 72 attached to the head covering 12. Also, the battery 70 is covered by a plate 74. Since the wiper means 18 includes the inner blade 64 as well as the outer blade 66, any blurring inside the window 20 can be cleared up.

Incidentally, in case air is inhaled from the front lower part, the outer conduit 44 is directed downwardly, while in case air is inhaled from the back part or thereabouts, the outer conduit 44 is turned in the proper direction.

The invention has been described with reference to a specific embodiment, but it is to be understood that description is illustrative and the invention is only limited by the hereto appended claims.

What I claim is:

1. A face mask comprising a head covering to substantially cover the head of the wearer, said head covering having a transparent window, sealing means secured to said head covering for isolating the inside of said head covering from the atmosphere when said head covering is worn, a hollow joint member having upper and lower ends and an opening at a side section thereof, outer conduit means, one end being rotatably secured to a front lower portion of said head covering and the other end being secured to said upper end of said joint member, inner conduit means connected at one end to said opening of said joint member and extending within said outer conduit up to said front lower portion of said head covering, a flexible conduit means secured at one end to said lower end of said joint member and having a free end to which filter means is connected, first valve means operatively situated in said joint member so that when air is inhaled into said head covering, only said first valve means opens, second valve means operatively situated at a free end of said inner conduit means so that when air is exhaled to the atmosphere, only said second valve means opens, and wiper means secured at a front upper portion of said head covering.

2. A face mask as claimed in claim 1, said wiper means comprising motor means, battery means and inner and outer blades operatively connected to said motor means, whereby when said wiper means is operated, the inside surface of said window as well as the outside surface thereof can be cleared.

3. A face mask as claimed in claim 1, said sealing means including first fastening means at an upper area thereof to be detachably connected to the neck portion of said head covering and second fastening means at a lower area thereof to be fixed to the neck of the wearer.

* * * * *